US008366031B2

(12) United States Patent
Comer

(10) Patent No.: US 8,366,031 B2
(45) Date of Patent: Feb. 5, 2013

(54) MILL APPARATUS HAVING VARIABLE AIR FLOW PORT RING AND METHOD

(76) Inventor: Paul Andrew Comer, Stafford (GB)

( * ) Notice: Subject to any disclaimer, the term of this patent is extended or adjusted under 35 U.S.C. 154(b) by 227 days.

(21) Appl. No.: 12/671,297

(22) PCT Filed: Jun. 19, 2008

(86) PCT No.: PCT/GB2008/050465

§ 371 (c)(1),
(2), (4) Date: Mar. 9, 2010

(87) PCT Pub. No.: WO2009/016395

PCT Pub. Date: Feb. 5, 2009

(65) Prior Publication Data

US 2010/0193615 A1 Aug. 5, 2010

(30) Foreign Application Priority Data

Jul. 31, 2007 (GB) ..... 0714812.5

(51) Int. Cl.
*B02C 15/00* (2006.01)

(52) U.S. Cl. ..... 241/119

(58) Field of Classification Search ..... 241/117–121
See application file for complete search history.

(56) References Cited

U.S. PATENT DOCUMENTS

| | | | | |
|---|---|---|---|---|
| 3,491,954 A | | 1/1970 | Miller | |
| 4,084,754 A | | 4/1978 | Brundiek | |
| 4,598,872 A | | 7/1986 | Henne et al. | |
| 5,127,590 A | * | 7/1992 | Bunton | 241/119 |
| 5,186,404 A | | 2/1993 | Wark | |
| 5,549,251 A | * | 8/1996 | Provost | 241/119 |
| 5,667,149 A | | 9/1997 | Eisinger | |
| 5,819,947 A | * | 10/1998 | Nardi et al. | 209/139.2 |
| 5,908,167 A | * | 6/1999 | Provost | 241/119 |
| 5,944,270 A | * | 8/1999 | Farris | 241/119 |
| 5,957,300 A | * | 9/1999 | Nardi et al. | 209/143 |
| 6,409,108 B1 | * | 6/2002 | Wark et al. | 241/119 |

FOREIGN PATENT DOCUMENTS

JP 61 050648 A 3/1986

OTHER PUBLICATIONS

International Search Report dated Oct. 22, 2008 for PCT/GB2008/050465.

United Kingdom Search Report dated Oct. 3, 2008 for GB 0714812.5.

* cited by examiner

*Primary Examiner* — Faye Francis

(74) *Attorney, Agent, or Firm* — Shumaker, Loop & Kendrick, LLP

(57) ABSTRACT

A mill having a grinding member carrying one or more fixed openings (37) at its periphery, wherein in the vicinity of the fixed opening(s) there is provided one or more variable openings (36), the fixed and variable openings permitting air to flow from beneath the grinding member to above the grinding member. This arrangement allows for good air flow control; air speed may be kept desirably low even when the mill must be run at a high mass flow rate.

11 Claims, 7 Drawing Sheets

MILL APPARATUS HAVING VARIABLE AIR FLOW PORT RING AND METHOD

TECHNICAL FIELD AND BACKGROUND OF THE INVENTION

This invention relates to industrial apparatus, namely a mill, in which pieces of a material are pulverised into a finer particulate form. The invention relates particularly, but not exclusively, to a mill in which coal is pulverised into a powder form which is conveyed to combustion apparatus e.g. of a power station.

In particular the invention concerns a mill having a lower grinding member, which may be a grinding ring formed with an annular depression. Grinding elements are sandwiched between the lower grinding member and a top member, which may be a top ring.

Typically the required relative movement between the grinding elements and the lower grinding member is achieved by driving the grinding member, while the top member is held against rotation. The grinding elements, which are typically steel balls or rollers, are not driven. They may be fixed or free to precess.

The mill with which the invention is concerned is of the type having a rotating port ring generally as described in EP 0507983. Such a port ring is provided, between the periphery or circumference of the grinding ring and the wall of the mill. There is provided an annular passage or "throat", just outboard of the grinding ring. Air flows upwardly through the port ring. The port ring has a plurality of spaced-apart vane members. The port ring rotates with the grinding ring and the vane members to impart a desired vector to the generally upwards air flow.

The rotating port ring is an excellent and successful mill feature but we have realised that the provision of a fixed area for the passage of upwardly impelled air is a limitation. Coal sources vary, as do desired operating speeds and coal throughputs. Increasing the airflow rate e.g. to accommodate an increase in coal throughput means increasing the air speed, and that increases the risk that non-combustible mineral materials may be carried forward to the combustion apparatus, along with desired coal fines.

BRIEF SUMMARY OF THE INVENTION

In accordance with a first aspect of the present invention there is provided a mill having a grinding member carrying one or more fixed opening(s) at its periphery, wherein in the vicinity of the fixed opening(s) there is provided one or more additional opening(s) of variable extent (hereinafter "variable opening(s)") the fixed and variable openings permitting air to flow from beneath the grinding member to above the grinding member.

Preferably the or each said additional variable opening is closable.

Preferably the or each variable opening has a fully open condition and a fully closed condition. Preferably the or each variable opening has at least one condition in between, and preferably a plurality, more preferably a continuum, of conditions in between.

Preferably the or each variable opening is associated with a closure or blanking part which may be moved so as to change the condition of the variable opening. Preferably the or each closure part is slid over or under its opening, to change the effective area of the opening. Preferably the variable opening(s) are provided in an annular part which is U-shaped in cross-section, and the closure part is an annular part which is U-shaped in cross-section, nested against, and supported in rotation by, the annular part containing the variable opening(s).

The or each closure part may be moved by means of a control member, for example a lever, push-pull member, worm and wheel, or rack and pinion gear, the rack being connected to the closure part and the pinion being connected to a control member, for example a control wheel or handle, on the outside of the mill.

The movement of the closure part could be powered by mechanical, electrical, pneumatic or hydraulic means.

Preferably a plurality of variable openings is under the control of a common control member.

Preferably the grinding member is generally annular or circular in plan view, and the periphery therefore may also be called a circumference. The grinding member may be called a grinding wheel or grinding ring herein.

Preferably the or each variable opening is provided outside the fixed opening(s). Preferably there is present a liner outside the fixed opening(s), and the or each variable opening is provided in the liner, which is typically a downwardly slanted metal wall carried on the inside wall of the mill.

Preferably the or each variable opening is rectangular or arcuate.

When there is a plurality of variable openings, they are preferably in a circumferential array; each opening preferably being an arc of the circumference.

Preferably adjacent variable openings are separated in the circumferential direction by a land at least as long as the openings; preferably at least 1.1 times as long; and preferably up to 2 times as long. Thus the variable openings preferably occupy less than 180° of the extent of the circumference; preferably 60 to 160° thereof.

The variable openings can be arranged evenly around the periphery of the mill, or can be arranged in groups. For example they may be arranged in three groups, the groups being separated by long lands. With certain mills, which have fixed grinding members, it is not necessary to provide variable openings in the region of the grinding members; only in the regions between the grinding members.

Preferably the area of the variable opening(s), when fully open, is at least 10% of the area of the fixed opening(s), preferably at least 20%, preferably at least 30% and most preferably at least 40%.

Preferably the area of the variable opening(s), when fully open, is up to 200% of the area of the fixed opening(s), preferably up to 100%, more preferably up to 75%, most preferably up to 60%.

The fixed opening(s) could be provided by a throat at the periphery of the grinding member.

Preferably, however, the fixed opening(s) is/are comprised by a port ring generally as described in EP 507983A. Such a port ring is secured to the periphery of the grinding member and includes a plurality of spaced-apart vanes having upper and lower ends; wherein the vanes are preferably oriented at an angle in the range of 20° to 40° relative to a vertical axis in a manner such that the upper ends are tilted away from the direction of rotation of the grinding member.

There is typically a running clearance outside the port ring and this is a further fixed opening herein. In an embodiment having a port ring the fixed area available for air flow is the summation of the port ring openings and the running clearance.

The port ring of EP 507983A exhibits significant advantages over conventional pulverizer mill designs. Most importantly, it provides for air flow upwardly through the port ring in a manner such that the air flow is essentially vertical (as opposed to predominantly spinning or swirling movement obtained with some other apparatus). With such apparatus the air flow provides excellent upward transport of pulverized material (e.g., coal dust) with minimum required air velocity, and with low tendency to lift large particles.

However it is a limitation that when there is a need to change coal throughput, air speed must be changed in order to maintain the correct air-coal ratio, and hence the optimal velocity in the mill. When the air velocity is simply increased, as may happen in existing mills, there is an increased tendency to lift large pieces of mineral, and to advance them to the combustion apparatus. On the other hand when the air velocity is too low there is an adverse effect on the coal particle size distribution in the ground material advanced to the combustion apparatus, and consequently poor combustion.

The provision of variable opening(s) in the present invention substantially improves mill operation by permitting air velocity to be held within suitable limits, even when there are through large changes in throughput.

The opening(s) may be adjusted to vary the air flow rate (i.e. to allow more, or less, air to flow in a given time), but still at a desired air speed.

In accordance with a second aspect of the present invention there is provided a method of operating a mill as defined above, wherein in a first mode of operation requiring a first mass flow rate the mill is operated with the variable opening(s) closed; wherein in a second mode of operation requiring a higher mass flow rate the mill is operated with the variable opening(s) partly open; and wherein in a third mode of operation requiring a still higher mass flow rate the mill is operated with the variable opening(s) open to the maximum extent.

Operating the mill with the variable opening(s) partly open or open to the maximum extent reduces the requirement to increase the air speed.

Preferably the air speed is kept substantially constant (e.g. ±20% of the mid-value, preferably ±10%) during the method.

In accordance with a third aspect of the present invention there is provided a method of improving an existing mill having a port ring secured to the periphery of a grinding member of the mill for common rotation therewith, the port ring having a plurality of spaced-apart vanes having upper and lower ends, defining fixed openings, but without variable openings being provided in the mill; the mill having a mill liner mounted to the wall of the mill around the port ring; wherein the method comprises the replacement of the mill liner by a mill liner with variable openings, as hereinbefore defined.

In accordance with a fourth aspect of the present invention there is provided a method of improving a mill by fitment of a port ring (as defined herein) providing fixed openings and a mill liner providing variable openings (as defined herein).

Preferred features of the third and fourth aspects are any of the features defined above as being necessary or desirable features of the first or second aspects. Preferred aspects of the port ring are also as defined previously.

Prior mills having port rings which provide fixed openings are generally set up such that the highest air speed achievable is optimal for the maximum throughput of coal deliverable by the mill. The provision of the variable opening(s) of the present invention could in principle be used to provide extra flow area, giving the possibility of higher coal throughput. However this may not be desirable for several reasons, such as: limits to coal input rate; limits to grinding performance; limits to combustion performance. Therefore the fixed opening(s) are preferably reduced in area, compared with fixed opening(s) provided where variable opening(s) were not available. The loss in area of fixed opening(s) is compensated for by the availability of area of variable opening(s), as and when needed.

Thus, when a port ring is manufactured for use in the present invention it may be manufactured with smaller fixed openings than were previously provided; the variable openings then being able to provide an adjustment across a useful range, up to the maximum mill requirement.

In situations in which a port ring providing fixed openings is already present, the openings may be partially obtruded by a blanking piece or blanking pieces. These may be welded into place. They could entirely obtrude a proportion of the openings or could partially obtrude some or all of the openings.

BRIEF DESCRIPTON OF THE DRAWING

The invention will now be further described, by way of example, with reference to the accompanying drawings, in which.

DETAILED DESCRIPTION OF THE INVENTION

Figure 1:
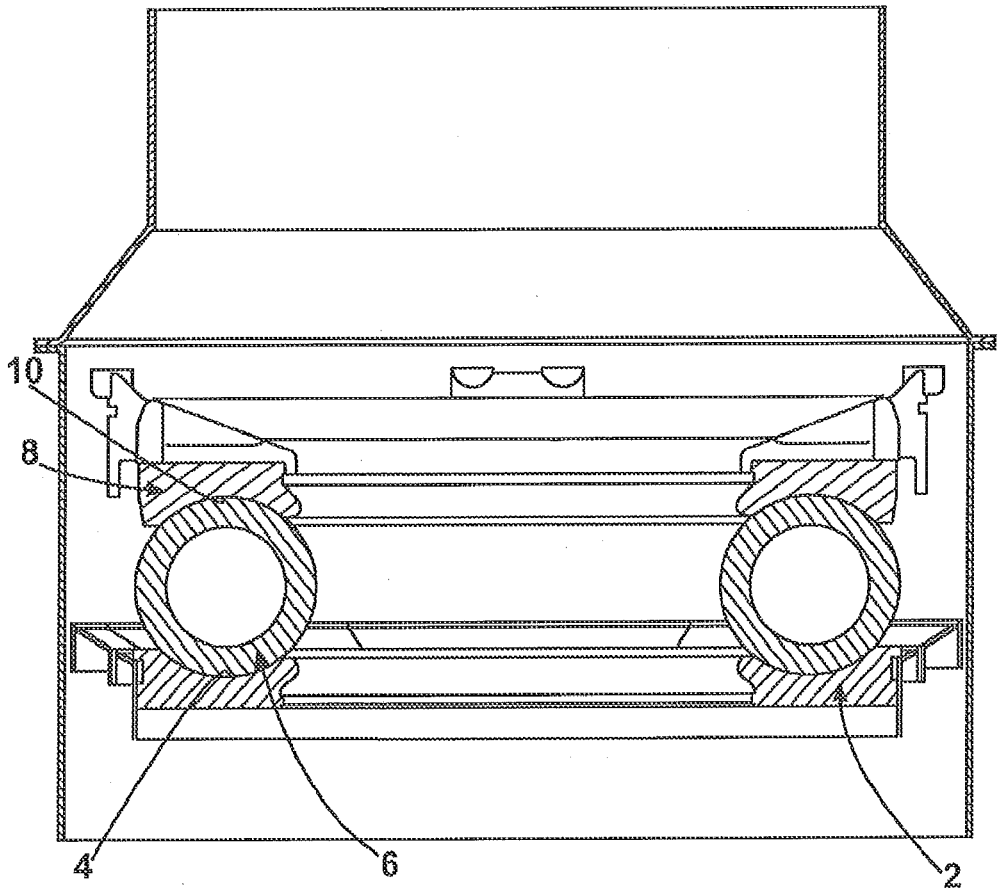
Fig. 1 Prior Art
FIG. 1 is a schematic side sectional view of the grinding part of a known pulverizer mill, in operational condition.
Figure 2:
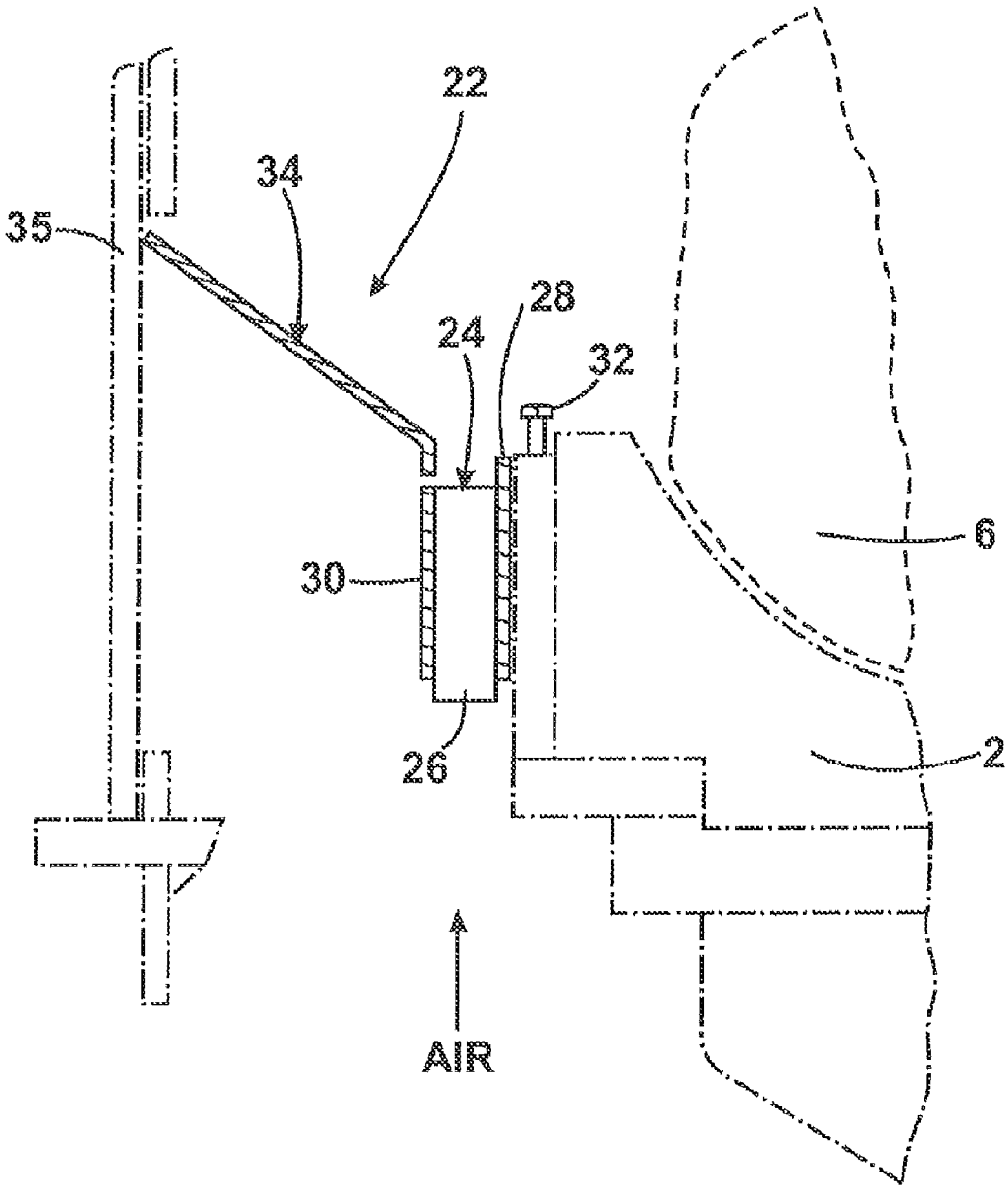
Fig. 2 Prior Art
FIG. 2 is a schematic expanded side sectional view of a side region of a similar known pulverizer mill.
Figure 3:
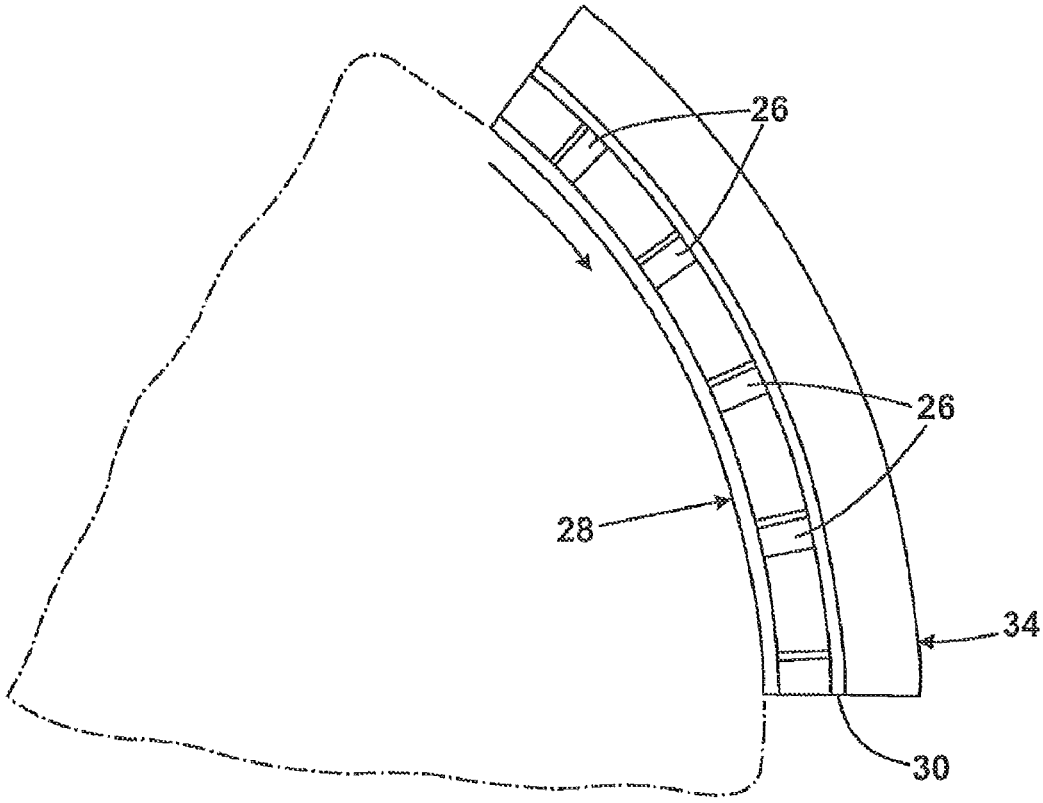
Fig. 3 Prior Art
FIG. 3 is a view from above of the region shown in FIG. 2.
Figure 4:
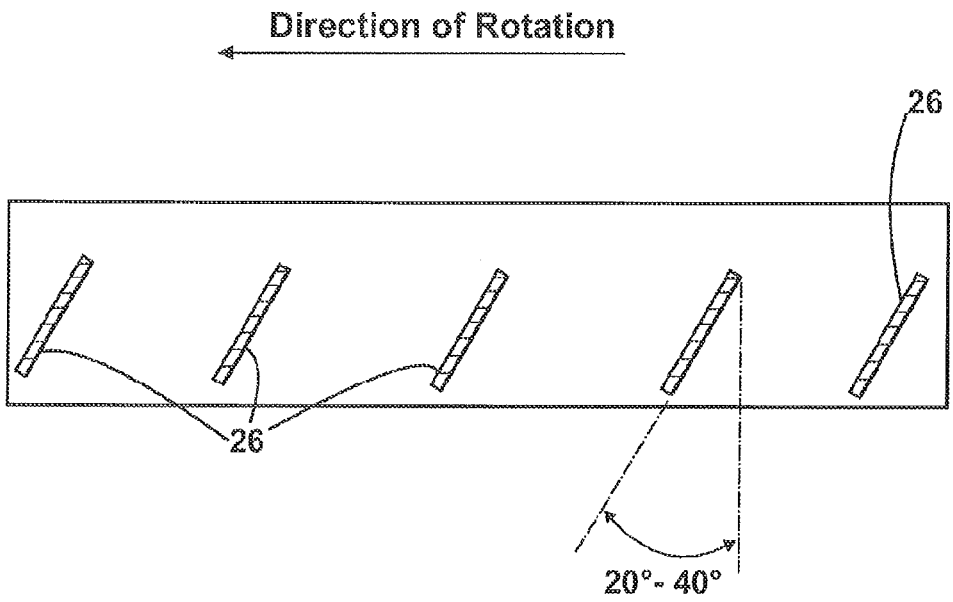
Fig. 4 Prior Art
FIG. 4 is a schematic drawing showing the arrangement of vanes, in the region shown in FIGS. 2 and 3.
Figure 5:
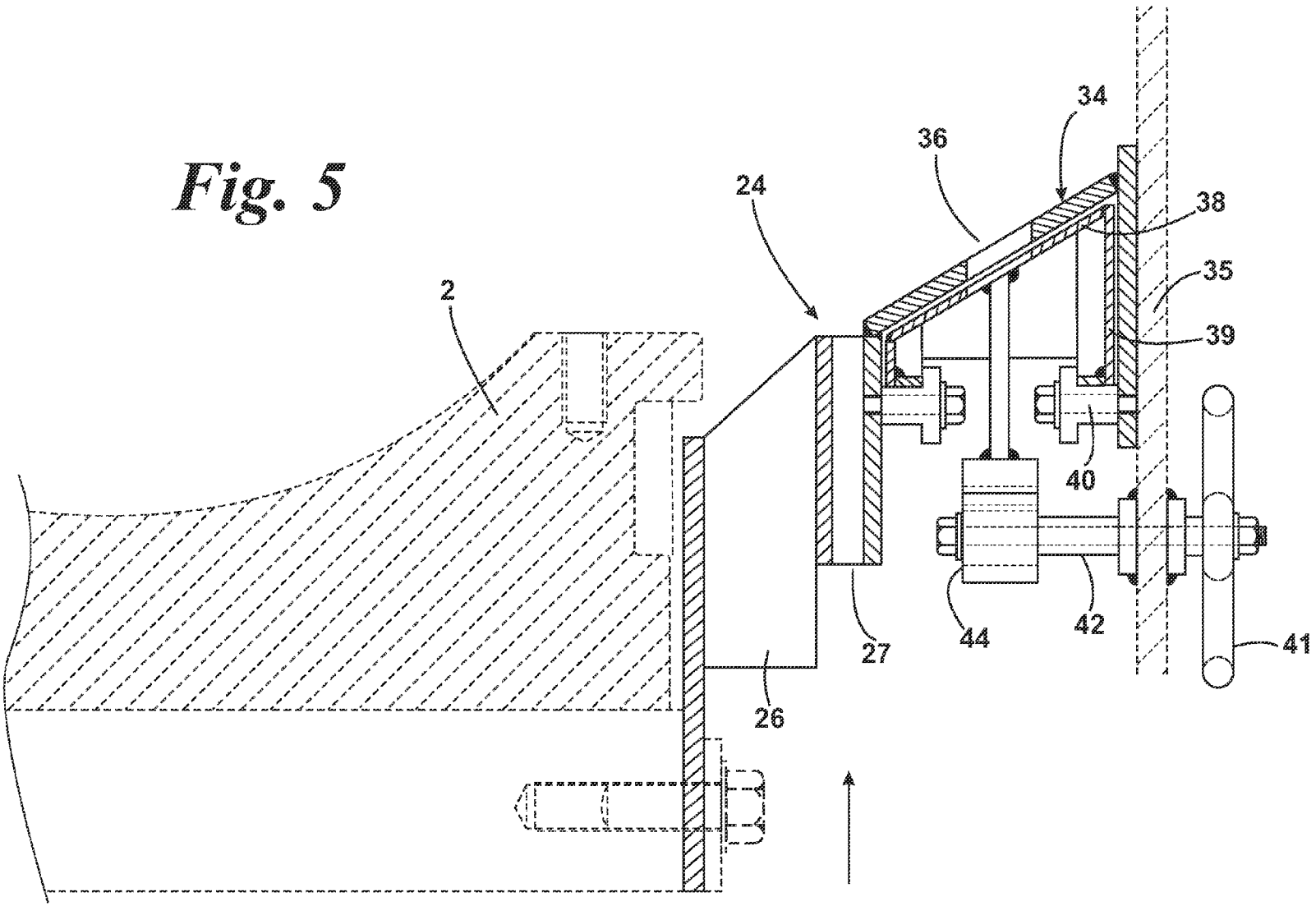
FIG. 5 is a side section view of an edge region of a mill, illustrating the invention, in a first embodiment.
Figure 6A:
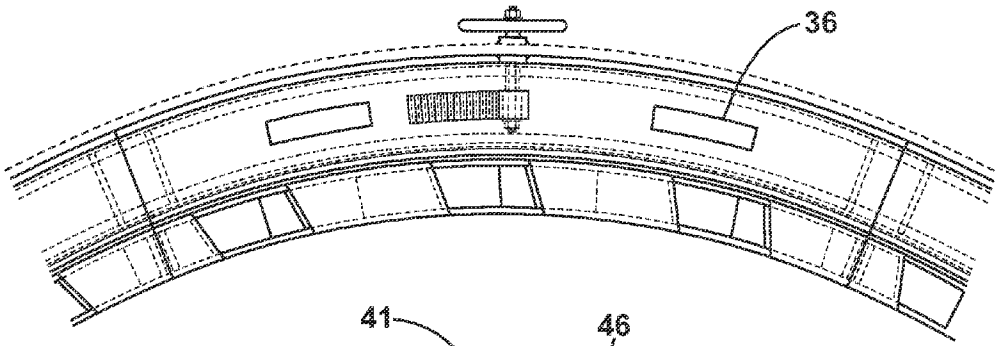
FIGS. 6A-6C are plan views, showing the side region of the first embodiment in different stages of operating.

FIGS. 1-4 show a prior mill in accordance with EP 507983A and FIGS. 5-6 illustrate the present invention, based upon the prior mill. Describing FIGS. 1-4 firstly:

The pulverizer mill has a driven, lower steel grinding ring 2 of annular shape. Grinding ring or wheel 2 has a circumferential groove 4, in which a plurality of grinding elements 6, e.g. steel rollers or balls, are located. Above the grinding elements is located a fixed (non-rotating) steel top ring 8, which has a downwardly-facing circumferential groove 10. Therefore the arrangement is like a ball race, with the grinding elements, free to precess within the oppositely-directed grooves 4, 10.

This type of pulverizer mill is used in a highly demanding environment, to crush coal into fines (powder) to be combusted. The coal fines are carried upwardly by an air current, towards the combustion apparatus.

Around the grinding ring 2 is a narrow throat 22 and in the throat 22 there is provided a port ring 24. This rotates as one with the grinding ring, to impart a desired movement to the upwardly-directed air, which carries the coal fines to the combustion apparatus.

The port ring comprises a plurality of spaced-apart vanes 26. The vanes 26 are welded between spaced-apart ring support members 28 and 30 which are inner and outer circumferential walls of the port ring. Support member 30 may be secured to the periphery of the grinding ring by means of bolts 32 or by welding, for example.

A mill liner member 34 extends downwardly from the inside wall of the mill body, to which it is preferably secured, towards the upper and outer edge of the port ring. Then the mill liner extends vertically downwardly to within about 1 cm of the upper and other edge of the port ring. The angle of inclination of the liner is typically between 30° and 60°, to the wall of the mill body.

Preferably the inner and outer peripheral walls 28, 30 of the port ring are vertical and are parallel to each other. The angle of inclination of the vanes is in the range of 20° to 40° from vertical. Preferably the angle of inclination is 25-30°. The upper ends of the vanes are tilted in a direction opposite to the direction of normal rotation of the grinding member. The flow of air through the port ring is in a substantially vertical direction.

Particles produced by the crushing or pulverizing process are carried upwardly by means of air passing through the port ring. Air flows upwardly in a nearly vertical manner with minimal swirling or spinning. As a result, the crushed particles are lifted upwardly in a smooth and efficient manner.

The invention will now be described with reference to the first embodiment of FIGS. 5 and 6A-6C.

The overall arrangement is similar to that described with reference to FIGS. 1-4, in its grinding apparatus, and in that a rotating port ring is provided. Like the port ring described with reference to FIGS. 1-4, the port ring 24 has a series of vanes 26, mounted to the grinding ring 2 outwith its circumference. The vanes are as described above. Between them are fixed openings 37. A running clearance 27 is shown between the port ring and the mill liner. The running clearance is typically about 1 cm. The running clearance and the fixed openings together constitute the fixed area available for air flow. However it will be seen that the inclined mill liner 34 is no longer a plain non-apertured sheet but has a series of circumferentially arranged, but spaced-apart, openings 36. Each opening is an elongated rectangle (but could be arcuate).

Figure 6B:
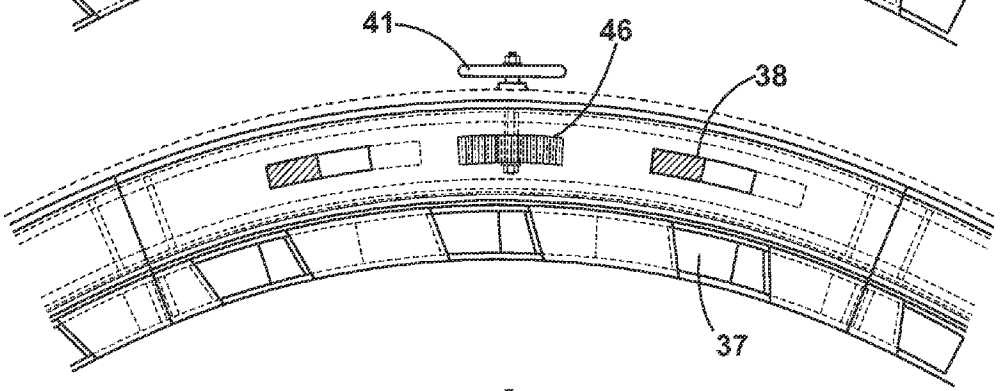
Figure 6C:
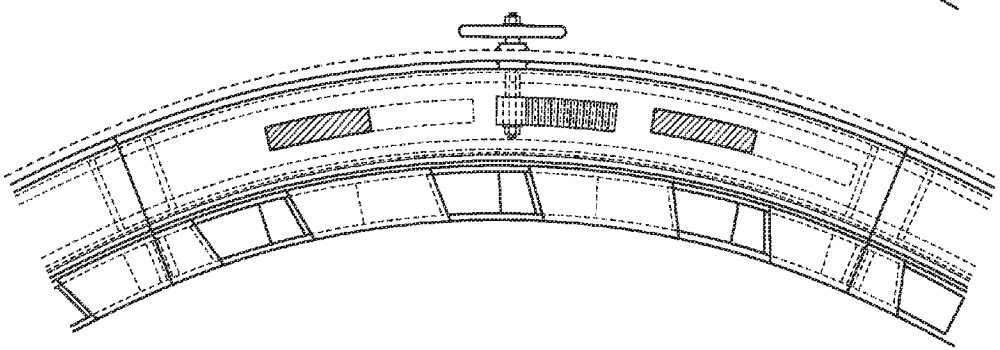

A blanking part 38 has openings which may be moved into register with the respective openings 36 in order to completely close them (see FIG. 6C); or be moved totally out of register with its respective opening in order to fully open it (see FIG. 6A); or may be moved to any position in between (see FIG. 6B). Blanking part 38 is a ring extending around the mill, close to the side wall. It has a shape which closely conforms to the shape of the space beneath the mill liner 34. It may be seen in FIG. 5 that the blanking part 38 nests closely in the space beneath the mill liner 34. It has vertical side walls 39 which are supported by bearers 40.

In the embodiment of FIGS. 5 and 6A-6C the arrangement of variable openings 36 in the mill liner is even all the way around the liner.

In this embodiment this movement to control the openings occurs under mechanical control. A single control wheel is mounted to the outside wall 35 of the mill. The wheel 41 is coupled to a shaft 42 which passes through the wall 35, and carries a pinion gear 44. The pinion gear is in mesh with a rack 46 shown schematically in FIGS. 6A-6C. The rack is mounted to a blanking part which has wheels (not shown) and which is mounted on a support track (not shown) such that turning the wheel 41 advances or draws back the circumferential band to bring each opening 36 to the same condition. By means of the simple common control it is assured that the airflow conditions around the mill are the same. It would be undesirable if certain openings were shut when others were open.

Figure 7:
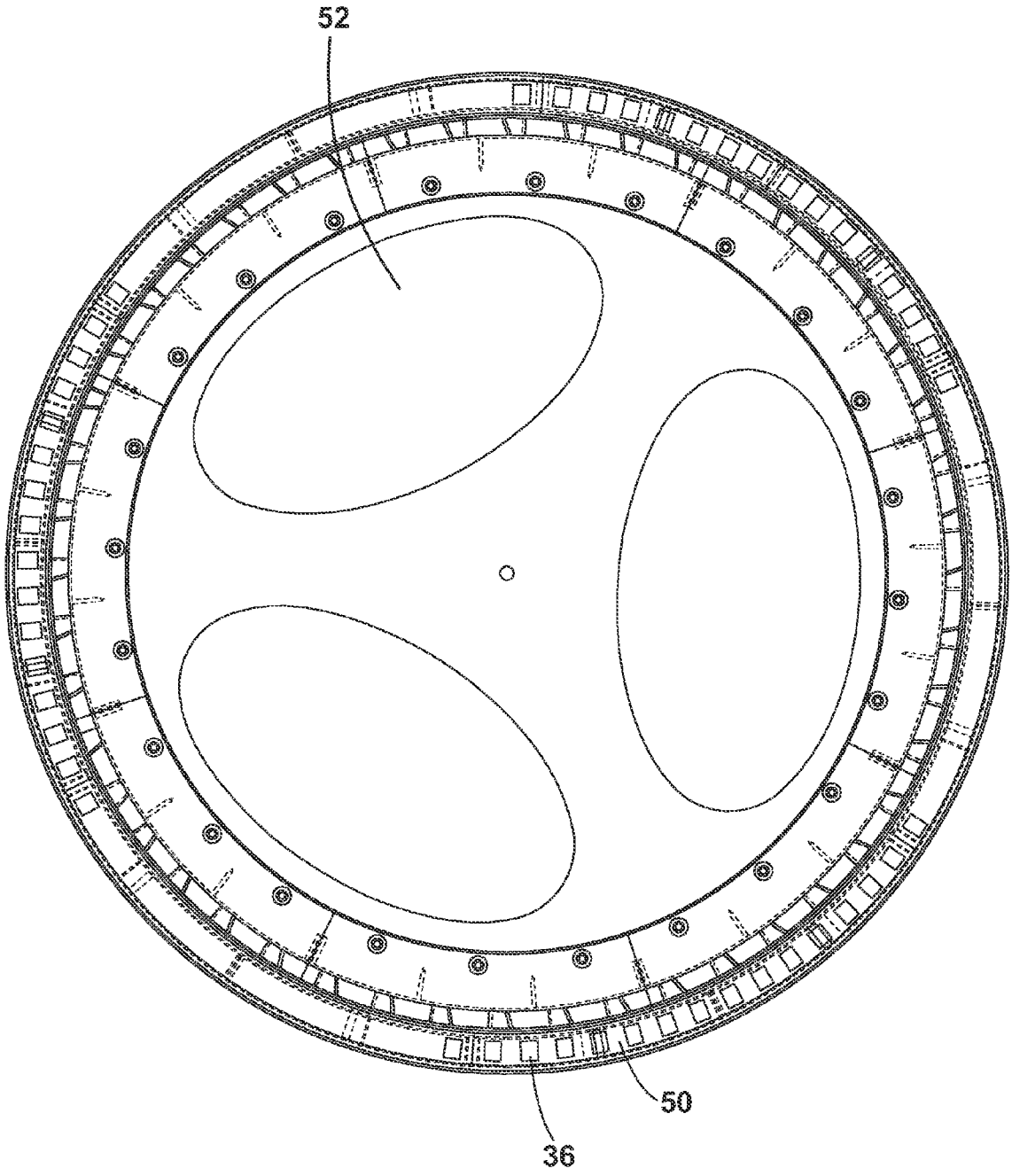
FIG. 7 is a plan view of a grinding ring, with a port ring and variable openings, in a second embodiment.

In the embodiment of FIG. 7 there is a different arrangement. The openings 36 are near-square. The lands 50 between them are only slightly longer than the openings 36. The openings 36 are in three groups, each group occupying approximately 60° of the circumference, with the respective groups being spaced apart by approximately 60° sections in which there are no apertures. In this embodiment the grinding members are indicated schematically as 52, and they are of the fixed type; they do not precess during grinding. For reasons of the air flow pathways required there is no need in this embodiment for the provision of variable air flow in the region between the grinding elements and the wall of the mill. However variable air flow is desirable in the other regions, between the grinding elements. Hence, each region where variable openings is provided is adjacent to a region between the grinding elements.

In each embodiment the summation of the variable openings 36 when fully open is approximately 50% of the summation of the fixed openings in the port ring 24 and the running clearance 27 outside it.

Provision of the variable openings 36 means that air speed may be kept at an optimum level across a wide range of airflow rates, and mass transfer rates.

As in the first embodiment nested, generally U-section parts—the mill liner 34 and the blanking part 38—are provided. The mill liner is fixed and the blanking part is movable, to open/close the variable apertures 36. However in this second embodiment the blanking part is advanced or retarded by a spur wheel and rack arrangement. In alternative embodiments these could be any of a number of arrangements, for example other mechanical arrangements e.g. worm and wheel; pneumatic apparatus; hydraulic apparatus; and electrical apparatus.

The invention claimed is:

1. A mill having a grinding member comprising:

a port ring having a circumferential array of fixed openings along its periphery; and a liner circumferentially spaced from and outside of the port ring having a circumferential array of openings of variable extent, the fixed openings and the openings of variable extent permitting air to flow from beneath the grinding member to above the grinding member;

wherein the total area of the openings of variable extent, when fully open, is from 10% to 200% of the total area of the fixed openings.

2. The mill as claimed in claim 1, wherein the openings of variable extent are associated with a closure part moveable to unblock, partially block or fully block the openings of variable extent.

3. The mill as claimed in claim 1, wherein the liner is inclined between 30° and 60° relative to a wall of the mill to which it is secured, and is spaced from the port ring by a circumferentially running clearance.

4. The mill as claimed in claim 1, wherein the fixed openings are arranged in a plurality of part-circumferential arrays around the port ring.

5. The mill as claimed in claim 4, wherein adjacent openings of variable extent are separated in the circumferential direction by a land at least as long as each opening.

6. The mill as claimed in claim 1, wherein opening and closing of the openings of variable extent is controlled by a control member outside of the mill.

7. The mill as claimed in claim 1, wherein the total area of the openings of variable extent, when fully open, is from 10% to 150% of the total area of the fixed openings.

8. The mill as claimed in claim 1, wherein the total area of the openings of variable extent, when fully open, is from 40% to 60% of the total area of the fixed openings.

9. The mill as claimed in claim 1, wherein there is a throat around the port ring providing a fixed opening between the port ring and the liner.

10. The mill as claimed in claim 1, wherein the port ring has a plurality of spaced-apart vanes separating the fixed openings.

11. The mill as claimed in claim 3, wherein the running clearance around the port ring prvoides an additional fixed opening.

* * * * *